United States Patent [19]

Entat

[11] 4,135,858

[45] Jan. 23, 1979

[54] METHOD OF PRODUCING PROPELLER BLADES AND IMPROVED PROPELLER BLADES OBTAINED BY MEANS OF THIS METHOD

[76] Inventor: Marcel Entat, 7 Bis, Boulevard Anatole, 92100 Boulogne-Billancourt, France

[21] Appl. No.: 690,931

[22] Filed: May 28, 1976

[30] Foreign Application Priority Data

Jun. 18, 1975 [FR] France ..... 75 19028

[51] Int. Cl.[2] ..... B63H 1/26

[52] U.S. Cl. ..... 416/223 R; 416/238; 416/DIG. 2

[58] Field of Search ..... 416/223, 238, DIG. 2, 416/DIG. 3

[56] References Cited

U.S. PATENT DOCUMENTS

| | | | |
|---|---|---|---|
| 870,136 | 11/1907 | Shaw | 416/238 |
| 1,019,437 | 3/1912 | Draper | 416/DIG. 2 X |
| 2,460,902 | 2/1949 | Odor | 416/DIG. 3 X |
| 2,468,723 | 4/1949 | Bartlett | 416/DIG. 3 X |
| 2,667,936 | 2/1954 | Clark | 416/223 |
| 3,367,423 | 2/1968 | VanRanst | 416/DIG. 3 X |

FOREIGN PATENT DOCUMENTS

| | | | |
|---|---|---|---|
| 423400 | 1/1935 | United Kingdom | 416/238 |
| 43306 | 10/1930 | Denmark | 416/223 |
| 2029021 | 12/1971 | Fed. Rep. of Germany | 416/DIG. 2 |
| 2356008 | 6/1974 | Fed. Rep. of Germany | 416/DIG. 2 |
| 290677 | 11/1931 | Italy | 416/229 |

*Primary Examiner*—Everette A. Powell, Jr.
*Attorney, Agent, or Firm*—Wenderoth, Lind & Ponack

[57] ABSTRACT

A propeller blade is rotatable about an axis of rotation and has a leading edge and a trailing edge. The blade has a configuration such that for any fixed point on the leading edge of the blade $\gamma$ has a maximum value of 90°, and for any fixed point on the trailing edge $\gamma$ has a maximum value of Arc cotg[(tg $\beta$)$^3$] wherein $\gamma$ is the angle between a radius extending from the axis of rotation to the fixed point and a vector from the fixed point in the direction of rotation of the blade, the vector lying in a plane which is perpendicular to the axis of rotation and which passes through the fixed point. The vector is normal to a section outline formed by the plane passing through the blade. $\beta$ is the angle between the plane and the chord of a cylindrical profile or corss-section of the blade formed by an imaginary cylinder concentric to the axis of rotation and passing through the fixed point.

5 Claims, 13 Drawing Figures

Fig. 4
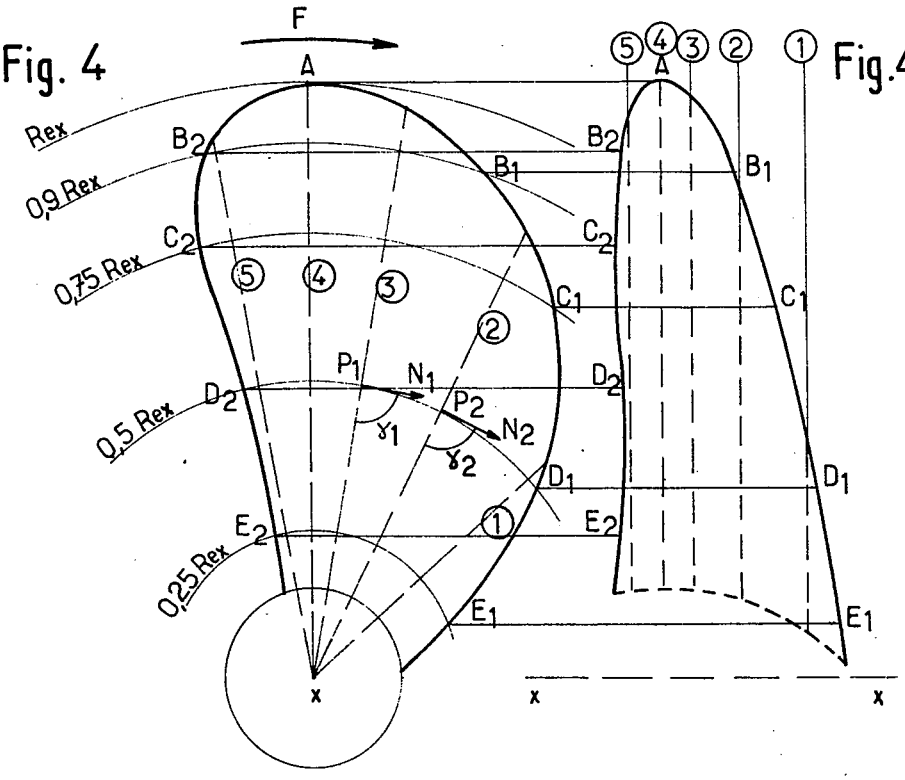
Fig.4a
Fig. 5
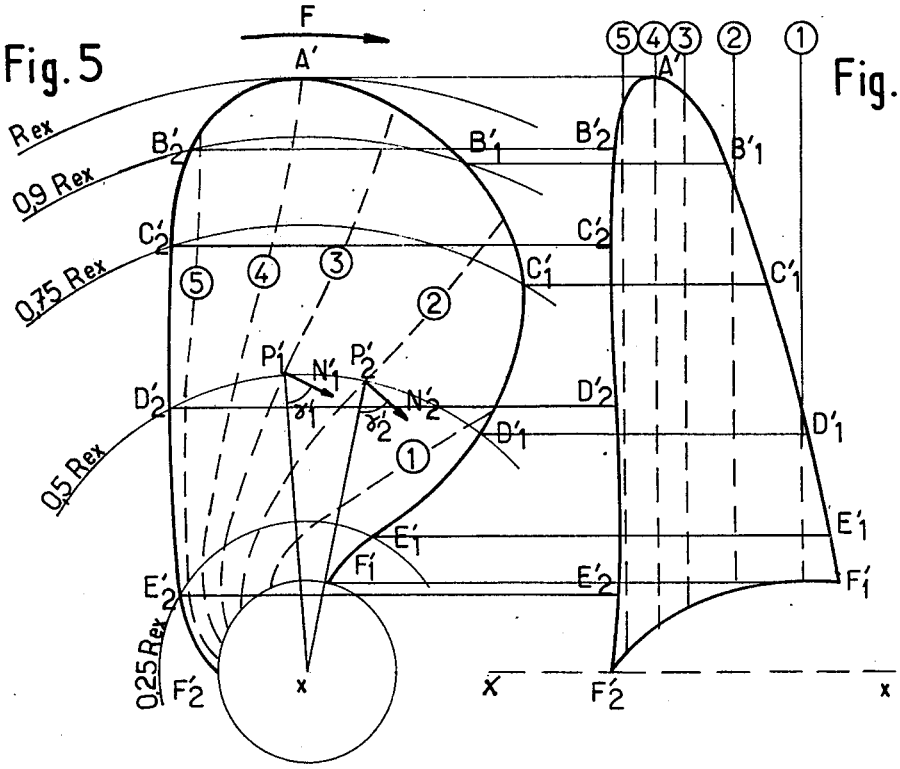
Fig.5a

METHOD OF PRODUCING PROPELLER BLADES AND IMPROVED PROPELLER BLADES OBTAINED BY MEANS OF THIS METHOD

BACKGROUND OF THE INVENTION

The present invention relates to a method of producing propeller blades and to blades obtained by such method.

As is well known, propellers are devices which comprise one or more blades, fixed to a rotatable shaft, and designed to produce a relative movement between the plane of rotation of the propeller and a flowable material surrounding the propeller, the relative speed of the fluid streams in comparison to the plane of rotation of the propeller remaining, over the entire surface swept by the propeller, as parallel as possible to the rotational axis of the propeller.

Propellers may be used either as a driving means, when working in a relatively unlimited fluid medium (marine or aeronautic propellers) or for circulating a flowable material in a closed circuit (ventilators, mixers etc.).

With, for example, a propeller for a mixer, the main aims are basically:

(A) to cause the passage into the zone of the propeller of the miscible or non-miscible phases contained in the mixer-container and to cause them to circulate therein in order to attain the desired homogeneity of the mixture.

(B) to ensure that, at all points of the mixture in circulation, speeds of suitable rates and direction are maintained to prevent separation of the mixture.

Moreover, in order to prevent the mixture from rotating as a body within the container, the containers are usually provided with fixed anti-rotation devices so that rotation of the mixture about the axis of the propeller is avoided and, the streams of mixture reaching the leading edge of the propeller blades have a displacement which is substantially parallel to the axis of rotation of the propeller.

In the present state of the art, the classical method of developing a propeller blade consists of successively studying different cross sections of the blade at pitch circles concentric with the axis of rotation e.g. at radii $R_1, R_2 \ldots R_n$ between the external radius Rex of the blade and the internal radius $R_i$ and which radii Rex and $R_1$ defining between them the effective radial length of the propeller. It should be noted that a so called "cylindrical profile" for a fixed radius R, comprises the cross section of the blade at radius R, from the axis of rotation, and that a "development of the cylindrical profile" comprises a flat development of this arcuate cross section. If the thickness of a cylindrical profile is slight relative to its chord, it is possible to consider the profile as a line without thickness (slim profile).

In this specification, the following terms have been adopted:

$\omega$ is the angular rotational speed of the propeller $\vec{\omega}R$ is the tangential speed of the blade for a radius R under consideration l is the length of the chord of the cylindrical profile, $\beta$ is the setting angle, i.e. the angle formed by the chord with a plane perpendicular to the axis of rotation, $\vec{V}$ is the absolute speed (assumed to be parallel to the axis of rotation) of the incident fluid medium, $\vec{W}$ is the relative speed of the fluid medium in relation to the leading edge of the blade ($\vec{W}=\vec{V}-\vec{\omega}R$), V' is the absolute speed of exit of the fluid medium, i is the angle of incidence of $\vec{W}$ relative to the chord l, $\alpha$ is the angle of $\vec{W}$ relative to the speed $\vec{\omega}R$($tg\alpha=tg(-\beta-i)=(V/\omega R)$ $\zeta$ is the rise of camber of the profile.

After having chosen a general form for the propeller, the establishment of the cylindrical profile for a determined radius R is effected by using the above noted classical method which allows calculation by successive approximations of the chord l, the setting angle $\beta$, the angle of incidence i (this angle should be sufficiently near its optimum value for which the ratio (drag/lift is minimal).

For an accurately determined cylindrical profile, the angle i is small in relation to $\beta$ and, at first approximation, the theoretical value of the axial component of the speed $V = \omega R\ tg(\beta-i)$ is in the region of $\omega R tg\beta$. The pitch of the blade for the rotation radius R is $2\pi R tg\ \beta$.

In order to define the respective cylindrical profiles corresponding to different blade radii, relations are sometimes used which join the value of the parameter $\beta$ to that of the corresponding radius R. In particular, in the case of propellers known as "constant pitch", such as the classical "marine" propellers, the product $R \cdot tg\ \beta$ is maintained constant over the entire length of the blade.

Having established the cylindrical profiles for different radii (for example $R = R_{ex}$, $R = 0.75\ R_{ex}$, $R = 0.5\ R_{ex}$, $R = 0.3\ R_{ex}$), the surface of the blade is the surface enclosing these different profiles. One can choose from an infinite variety of relative positions of a cylindrical profile corresponding to a certain radius in relation to that corresponding to another radius by making them slide relatively parallel to the axis of rotation or to turn about this axis. The choice of relative positions is generally made by successive tests in terms of other criteria which may be of construction, surface development, aesthetical appearance or the like.

The classical method described above does not take into account the fact that, in practice, the courses of the fluid streams while crossing the propeller deviate from the theoretical courses defined by the cylindrical profiles of the blades, particularly because the drag effect of the blade induces a tangential component of the speed of flux which increases from the leading edge to the trailing edge of the blade. Designating U as the value of this tangential component of the speed at a certain point of the trailing edge of the blade and V as the value of the axial component at this point, the ratio U/V increases (all other things being equal) as the angle $\alpha$ increases, as the radius R decreases, as the coefficient of loss of charge of the hydraulic circuit increases (therefore as the cinematic viscosity $\mu$ of the medium rises above a specific threshold).

For a weak pitch propeller turning in an unlimited incompressible medium the centrifugal effect produced by the tangential component of the speed of the fluid at each point is compensated by the internal depressions and the released flux is very slightly divergent. This does not apply to a propeller turning in a finite space (a mixer basin, for example) and where a centrifugal component of speed is produced. It follows that the fluid streams do not remain parallel to the axis of rotation and that, in particular, the central streams leave the propeller on a radius higher than that of entry and in a very divergent direction in relation to the axis of rotation. The result is a zone of low efficiency flux adjacent the propeller, in the vicinity of the roots of the blades.

SUMMARY OF THE INVENTION

The object of the present invention is to provide a propeller blade having shape which eliminates or at least reduces the centrifugal effect described above.

The above object is achieved according to the invention by providing that each propeller blade is formed by a succession of cylindrical profiles corresponding to different radii of a propeller blade with regard to their relative position and the relative dimensions of the parameters l and $\beta$ of such cylindrical profiles, each individual profile being established according to the above described classical method.

The invention applies to thick blades as well as thin blades.

According to a first feature of the invention, for each fixed point of the blade (located on the blade when it is thin or located in the case of a thick blade on the middle surface between its intrados and its extrados), the angle $\gamma$ is always less than a specific certain value. The angle $\gamma$ is contained between a radial vector to the axis of rotation of the blade from such fixed point, and a vector from such fixed point extending in the direction of rotation of the blade and lying in a plane perpendicular to the axis of rotation and normal to the outline of the section of the blade by such plane.

At any point of the leading edge of the blade such specific value is 90°, and at the trailing edge of the blade, for each given rotation radius R such specific value is Arc cotg[(tg $\beta$)$^3$] $\beta$ being the settling angle of the chord of the cylindrical profile of radius R.

A further feature of the invention is the variation of the length of the chords of the cylindrical profiles from the hub to the extreme radius of the blade, arranged preferably in such a way that the product R $\times$ l remains substantially constant.

A still further feature of the invention is the variation of settling angle $\beta$ of the chords of the cylindrical profiles, arranged preferably in such a way that the product R $\times$ tg $\beta$ remains substantially constant.

BRIEF DESCRIPTION OF THE DRAWINGS

The invention will now be described further by way of example with reference to the accompanying drawings, wherein:

FIG. 4 is a schematic axial view illustrating the angle ($\gamma$) for a known type of propeller blade;

FIG. 4*a* is a schematic side view of the blade of FIG. 4 with the different section planes illustrated;

FIG. 5 is a schematic axial view, in accordance with the above first feature of the invention, of a blade having the same cylindrical profiles as the blade of FIG. 4;

FIG. 5*a* is a schematic side view of the blade of FIG. 5 with the different section planes illustrated;

The parameter recognised by the present invention and the judicious choice of which for each point (M) of the blade constitutes a desirable characteristic of the present invention, is represented by the angle ($\alpha$) defined below.

Figure 1:
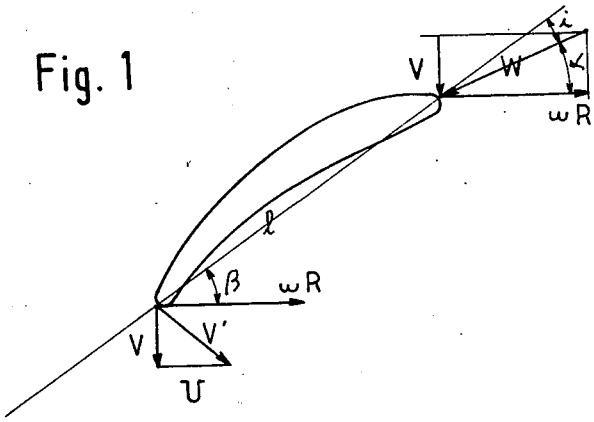
FIG. 1 is a schematic view of a development of a cylindrical profile of radius (R) of a thick propeller blade.
Figure 2:
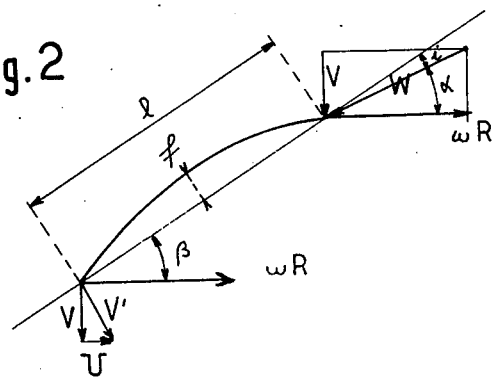
FIG. 2 is a view similar to FIG. 1 of a thin blade.
Figure 3:
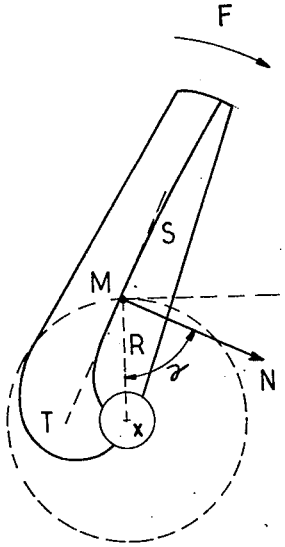
FIG. 3 is a schematic axial view illustrating the orientation and size of the angle ($\gamma$)
Figure 6:
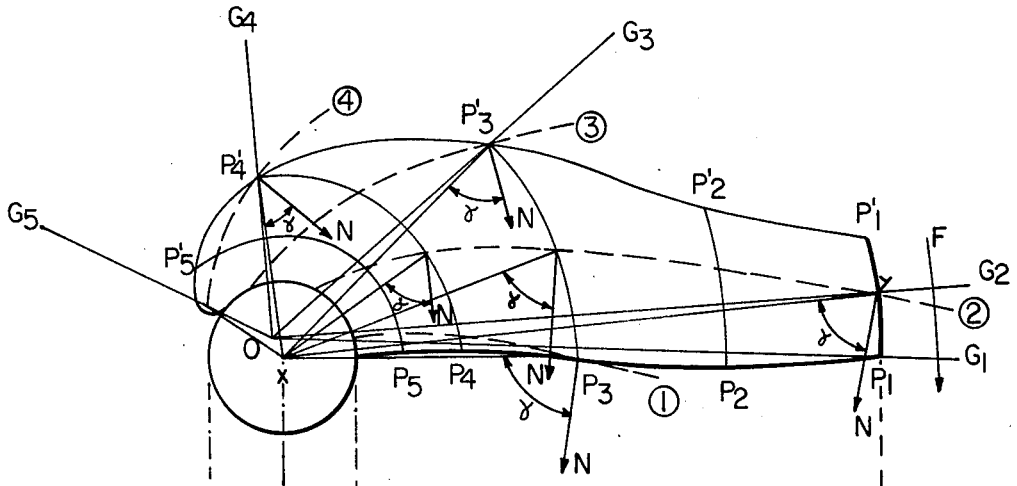
FIG. 6 is an axial view of a blade according to all of the above features of the invention, showing the value of the angle ($\gamma$) at different points on the blade.
Figure 7:
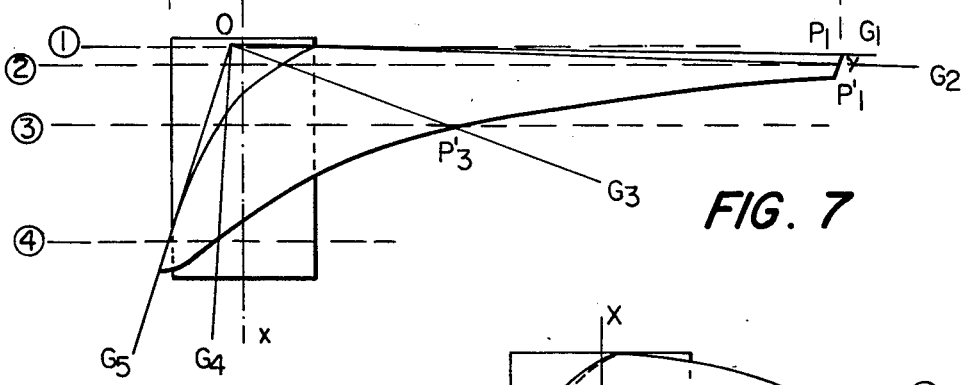
FIG. 7 is a side view of the blade illustrated in FIG. 6 showing different cutting planes therethrough.
Figure 5B:
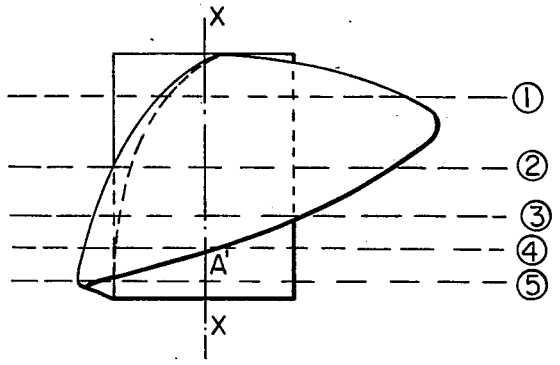
FIG. 5*b* is a view of the blade of FIG. 5 following the radius through A' thereof.
Figure 5C:
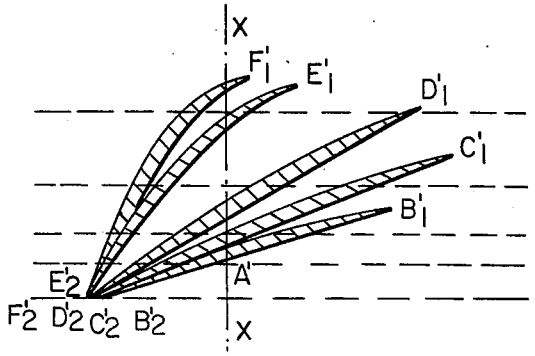
FIG. 5*c* shows the projection on a plane perpendicular to the radius through A' of the different cylindrical profiles.
Figure 8A:
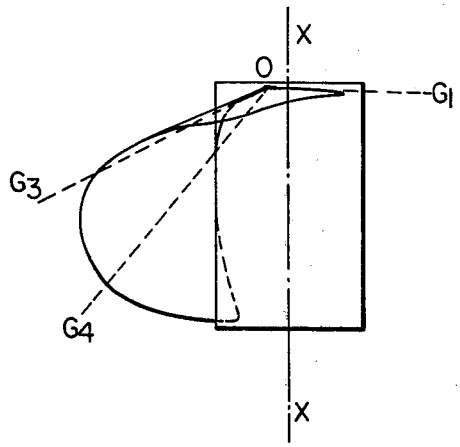
FIG. 8*a* is a view following the radius through the middle y of profile $P_1P'_1$ of the blade.
Figure 8B:
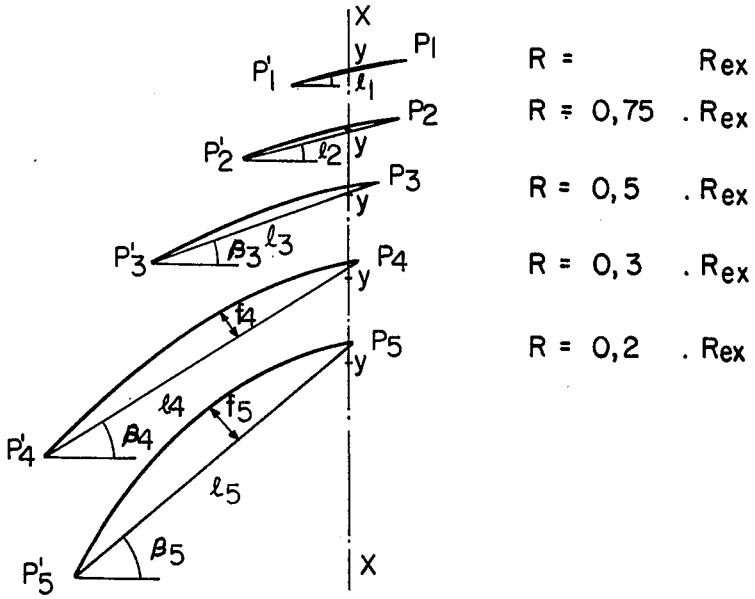
FIG. 8*b* shows the projection on a plane perpendicular to the radius through point y of different cylindrical profiles of the blade, and wherein for the purpose of clarity the different profiles have been offset vertically, the reference mark being point y.

Specifically in FIG. 3 there is shown a fixed point M, located on the blade surface when the blade thickness is small, or on the median plane between the major faces of the blade when the blade has substantial thickness. The full line S passing through point M is the section of the blade made by a plane passing through point M, and perpendicular to the rotational axis X.

At point M the angle $\alpha$ extends between vector N which is normal to line S in the direction of rotation, and the radius to point M.

If the angle ($\alpha$) at a point (M) has a value less than 90°, the blade will have, in the vicinity of point M, a centripetal effect on the flux speed, an action which comes by deduction from the centrifugal actions which are exerted in the vicinity of point (M).

Conversely, if the angle ($\alpha$) is greater than 90°, a supplementary centrifugal action will be produced.

It is possible to concede that, to obtain the optimum form of flux, the centripetal action should balance the centrifugal action created by the tangential speed induced while crossing the blade.

Over the entire length of the leading edge of the blade, if the incident flux speed is assumed without a tangential component, angle ($\alpha$) providing such balance is $\alpha_a = 90°$. (If the incident flux already has a tangential component, $\alpha_a$ must be less than 90°).

Over the trailing face of the blade at a point (M) at a distance (R) from the axis of rotation, the value of the angle ($\alpha$) at which the balance is attained is approximately $$\alpha_f = \text{Arc cotg } [(\text{tg } \beta)^3 -]$$

$\beta$ being the setting angle of the cylindrical profile for the rotation radius R.

If the viscosity of the medium is increased, the value $\alpha_f$ must be increased. For example, for a blade having an external radius equal to one meter turning in a medium with a viscosity index of 1000 cPo, the formula is approximately:

$$\alpha_f = \text{Arc cotg } [1.2 \, (\text{tg } \beta)^3].$$

If at a point of the trailing face of the blade the value of the angle ($\alpha$), while being less than 90°, is not less than $\alpha_f$, compensation of the centrifugal action at this point will only be partial.

On the other hand, there is no reason why the angles ($\alpha$) on the leading face and on the trailing face should not be less than the respective values $\alpha_a$ and $\alpha_f$. It is therefore recommended in practice that the blades according to the present invention should be constructed with values of ($\alpha$) which are less than the above values $\alpha_a$ and $\alpha_f$.

It is preferable that, along the same cylindrical profile, the value of the angle ($\alpha$) should constantly decrease from the leading edge to the trailing edge of the blade.

FIGS. 4 and 4*a* and FIGS. 5, 5*a*, 5*b* and 5*c* of the drawings show by way of example the difference between the shape of a conventional type marine propeller and a propeller in accordance with the invention, both having the same cylindrical profiles for the blades.

Considering first the conventional propeller shown in FIGS. 4 and 4*a* the different sections (1), (2), (3), (4) and (5), (corresponding to S in FIG. 3) are straight lines which pass through or radiate from the axis of rotation, when viewed axially as in FIG. 4. In FIG. 4*a*, these different section planes can be seen spaced apart relative to the axis of rotation. It will be observed that the vectors $N_1$ and $N_2$ at points $P_1$ and $P_2$, normal to the section lines 3 and 2, respectively, are also tangent to a circular section $D_1D_2$. Consequently, $\gamma_1$ and $\gamma_2$ are right angles.

FIG. 5 is a view in the direction of the axis of rotation of the blade, according to the invention and constructed with the same cylindrical profiles but at different radii as the FIG. 4 embodiment and with the profiles displaced about the axis of rotation of the blade, the profile $B_2B_1$ of FIG. 4 thereby becomes $B'_2B'_1$, in FIG. 5 the profile $C_2C_1$ becomes $C'_2C'_1$, the profile $D_2D_1$ becomes $D'_2D'_1$ and the profile $E_2E_1$ becomes $E'_2E'_1$. It should be observed that, by displacing the profiles, the section lines 1, 2, 3, 4 and 5 in the FIG. 5 view are circumferentially displaced to define curves. The vectors $N'_1$ and $N'_2$ of points $P'_1$ and $P'_2$ now make a smaller angle $\alpha'_1$ and $\alpha'_2$ with respect to section lines 3 and 2 and vectors $N'_1$ and $N'_2$ lie below the tangents to section $D'_1D'_2$ at points $P'_1$ and $P'_2$, respectively, i.e. $\alpha'_1$ and $\alpha'_2$ are less than 90°.

It is of course possible to combine these displacements or rotations of the cylindrical profiles with displacements parallel to the axis of rotation in order to obtain a blade of a different configuration and appearance while still conforming with the concept of the present invention.

It is advantageous for obtaining the most efficient blade structure according to the invention to maintain constant for all the profiles the value of the product of the parameters R and l, and also the product of the parameters R and $\beta$, such parameters being defined above.

It is also within the scope of the present invention to combine the constancy of this product with the maintenance of a fixed value for the angle ($\alpha$).

According to a particularly simple method of constructing a propeller blade according to the present invention, the blade is formed of a thin sheet of a suitable material which is shaped to define part of the surface of a cone.

Such blade is shown in FIGS. 6, 7, 8*a* and 8*b* and wherein:

- the axis x — x represents the axis of rotation for the blade
- the point O represents the apex of the cone
- the straight lines $G_1$, $G_2$, $G_3$, $G_4$ and $G_5$ represent generating lines of the cone
- the circular arcs $P_1P'_1$, $P_2P'_2$, $P_3P'_3$, $P_4P'_4$ and $P_5P'_5$ represent cylindrical profiles or sections of the blade, centered on the axis of rotation x — x, y is the mid-point of the cylindrical profile $P_1P'_1$.
- the lines (1), (2), (3), (4) represent the outlines of the sections (S) of the blade at different planes perpendicular to the axis of rotation, the vectors (N) at each point of these outlines forming a specific angle $\alpha$ with the corresponding rotation radius (R).

The cylindrical profile corresponding to the external rotation radius $R_{ex}$ is determined according to the above mentioned known classical method, the outline of the blade being substantially circular with a relative chamber f/l contained preferably between 2 and 4%. This profile constitutes the departure portion of the generatrix of the cone of which the summit is determined as follows.

The apex O of the cone, in relation to the axis of rotation x — x of the blade on the one hand and in relation to the plane (Q) perpendicular to this axis and passing beyond the extremity $P_1$ (leading side face edge) of the cylindrical profile of radius $R_{ex}$ on the other hand, is located for example:

a. in the plane (Q) mentioned above or above this plane at a distance preferably less than 0.2 $R_{ex}$ so as not to reduce the flux efficiency above the propeller.

b. at a distance from the axis of rotation x — x of less than 0.1 $R_{ex}$ and in the region limited by the plane passing by this axis and perpendicular to the rotation radius of the point $P_1$, on the opposite side to this point $P_1$. All of the apex (O) of the cone situated in this region automatically provides good distribution of the angles ($\alpha$) and permits highly efficient cylindrical profiles to the extent of a blade radius as small as construction conditions allow, c. in the region limited by the plane passing by the axis of rotation and by the point $P_1$, on the trailing side of the blade relative to this plane, to obtain the blade shape having optimum mechanical resistance.

The conical projection from the apex (O) of the profile for $R_{ex}$ on a cylinder centered on the axis of rotation of radius 0.75 $R_{ex}$, for example, provides a part of the cylindrical profile for $R = 0.75\ R_{ex}$ which is completed on the side of the trailing face (and of the leading face if necessary) using the known classical method while preferably keeping the factors $R \cdot \text{tg}\ \beta$ and $R \cdot l$ substantially constant. Thus, one operates gradually towards a minimum radius, for example 0.3 $R_{ex}$ and even less.

The sequence of operations described above and indicated by way of example may be modified, the result remaining the same.

The generatrix (G) which gives maximum efficiency is a continuous curve line; however, it may be replaced by an adjacent broken line, technically the same, the conical shape of the blade becoming a pyramid shape.

It will be appreciated that the invention has been described and illustrated purely by way of example, and that many modifications of detail can be effected to the specific features shown in FIGS. 5 through 8*b* without departing from the scope of the invention.

I claim:

1. A propeller blade adapted to rotate about an axis of rotation and to extend outwardly therefrom, said blade having a leading edge and a trailing edge with respect to the direction of rotation of said blade about said axis of rotation, said blade having a configuration such that for any fixed point on said leading edge $\gamma$ has a value less than 90°, and for any fixed point on said trailing edge $\gamma$ has a maximum value of Arc cotg$[(\text{tg}\ \beta)^3]$, wherein $\gamma$ is the angle between a radius extending from said axis of rotation to said fixed point and a vector from said fixed point in the direction of rotation of said blade, said vector lying in a plane which is perpendicular to said axis of rotation and which passes through said fixed point, said vector being normal to a section outline formed by said plane passing through said blade, and wherein $\beta$ is the angle between said plane and the chord of a cylindrical profile or cross-section of said blade formed by an imaginary cylinder concentric to said axis of rotation and passing through said fixed point, said planes intersecting the working face of said blade to form curves which are at least partially convex or concave in the direction of rotation of said blade.

2. A propeller blade as claimed in claim 1, wherein for all cylindrical profiles along the effective length of said blade, $l \times R$ = constant, wherein l is the length of the chord of a given cylindrical profile, and wherein R is the radius of said given cylindrical profile from said axis of rotation.

3. A propeller blade as claimed in claim 1, wherein for all cylindrical profiles along the effective length of said blade, $R \times \text{tg}\ \beta$ = constant, wherein R is the radius of a given profile from said axis of rotation.

4. A propeller blade as claimed in claim 1, wherein said blade is in the form of a thin sheet of material shaped to form a portion of the surface of a cone having an apex located at a position within a cylindrical volume which is concentric to said axis of rotation and which has a radius less than 0.1 times the length of the external radius of said blade, said apex of said cone being located at a position other than said axis of rotation.

5. A propeller blade adapted to rotate about an axis of rotation and to extend outwardly therefrom, said blade having a leading edge and a trailing edge with respect to the direction of rotation of said blade about said axis of rotation, said blade having a configuration such that for all cylindrical profiles or cross-sections along the effective length of said blade formed by imaginary cylinders which are concentric to said axis of rotation and which pass through said blade at different radii, $l \times R$ = constant, wherein l is the length of the chord of a given cylindrical profile, and wherein R is the radius of said given cylindrical profile from said axis of rotation, said blade being in the form of a thin sheet of material shaped to form a portion of the surface of a cone having an apex located at a position within a cylindrical volume which is concentric to said axis of rotation and which has a radius less than 0.1 times the length of the external radius of said blade, said apex of said cone being located at a position other than said axis of rotation.

* * * * *

UNITED STATES PATENT AND TRADEMARK OFFICE

CERTIFICATE OF CORRECTION

PATENT NO. : 4,135,858

DATED : January 23, 1979

INVENTOR(S) : Marcel ENTAT

It is certified that error appears in the above-identified patent and that said Letters Patent are hereby corrected as shown below:

Column 4, line 13, for "$\alpha$" read --$\gamma$--;
line 22, for "$\alpha$" read --$\gamma$--;
line 25, for "$\alpha$" read --$\gamma$--;
line 30, for "$\alpha$" read --$\gamma$--;
line 38, for "$\alpha$" read --$\gamma$--;
line 39, for "$\alpha_a$" read --$\gamma_a$--;

line 40, for "$\alpha_a$" read --$\gamma_a$--;

line 43, for "$\alpha$" read --$\gamma$--;
line 46, for "$\alpha_f$" read --$\gamma_f$--;

line 51, for "$\alpha_f$" read --$\gamma_f$--;

line 56, for "$\alpha_f$" read --$\gamma_f$--;

line 59, for "$\alpha$" read --$\gamma$--;
line 60, for "$\alpha_f$" read --$\gamma_f$--;

line 63, for "$\alpha$" read --$\gamma$--;
line 64, for "$\alpha_a$" read --$\gamma_a$--; for "$\alpha_f$" read --$\gamma_f$--;

line 67, for "$\alpha$" read --$\gamma$--;
line 68, for "$\alpha_a$" read --$\gamma_a$--; for "$\alpha_f$" read --$\gamma_f$--;

UNITED STATES PATENT AND TRADEMARK OFFICE

CERTIFICATE OF CORRECTION

PATENT NO. : 4,135,858

DATED : January 23, 1979

INVENTOR(S) : Marcel ENTAT

It is certified that error appears in the above-identified patent and that said Letters Patent are hereby corrected as shown below:

Column 5, line 2, for "$\alpha$" read --$\gamma$--;
line 31, for "$\alpha'_1$" read --$\gamma'_1$--;

line 32, for "$\alpha'_2$" read --$\gamma'_2$--;

line 34, for "$\alpha'_1$" read --$\gamma'_1$--; for "$\alpha'_2$" read --$\gamma'_2$--;

line 50, for "$\alpha$" read --$\gamma$--;

Column 6, line 28, for "$\alpha$" read --$\gamma$--.

Signed and Sealed this

*Eleventh* Day of *September 1979*

[SEAL]

*Attest:*

*Attesting Officer*

LUTRELLE F. PARKER

*Acting Commissioner of Patents and Trademarks*